US006631821B2

(12) United States Patent
Vourganas

(10) Patent No.: US 6,631,821 B2
(45) Date of Patent: Oct. 14, 2003

(54) REINFORCED DOUBLE-WALL KNOCK-DOWN BIN

(76) Inventor: Peter N. Vourganas, 15 Cloverdale, Las Flores, CA (US) 92688

( * ) Notice: Subject to any disclaimer, the term of this patent is extended or adjusted under 35 U.S.C. 154(b) by 109 days.

(21) Appl. No.: 10/017,775

(22) Filed: Oct. 29, 2001

(65) Prior Publication Data

US 2003/0080024 A1 May 1, 2003

Related U.S. Application Data

(60) Provisional application No. 60/244,874, filed on Oct. 31, 2000.

(51) Int. Cl.[7] ..... B65D 88/00

(52) U.S. Cl. ..... 220/1.5; 220/4.33; 220/4.34; 206/600

(58) Field of Search ..... 206/600; 220/1.5, 220/4.28, 4.33, 4.34, 4.32

(56) References Cited

U.S. PATENT DOCUMENTS

| | | | | |
|---|---|---|---|---|
| 3,985,258 A | | 10/1976 | Quigley | 220/4 |
| 4,171,058 A | | 10/1979 | Collins | 217/12 |
| 4,674,647 A | | 6/1987 | Gyenge et al. | 220/6 |
| 4,887,731 A | * | 12/1989 | Pett et al. | 220/1.5 |
| 4,917,255 A | | 4/1990 | Foy et al. | 220/4 |
| 5,094,356 A | | 3/1992 | Miller | 220/7 |
| 5,161,709 A | | 11/1992 | Oestreich | 220/6 |
| 5,236,099 A | | 8/1993 | Fties et al. | 220/4.31 |
| 5,597,084 A | | 1/1997 | Parasin | 220/4.28 |
| 5,638,973 A | | 6/1997 | Dewey et al. | 220/4.33 |
| 5,931,326 A | * | 8/1999 | Weng | 220/4.33 |
| 6,142,329 A | | 11/2000 | Dotan | 220/4.33 |
| 6,216,899 B1 | * | 4/2001 | Vicari | 220/1.5 |

* cited by examiner

*Primary Examiner*—David T. Fidei
(74) *Attorney, Agent, or Firm*—Gordon K. Anderson

(57) ABSTRACT

A reinforced double-wall knock-down bin molded of plastic resin, comprising a pallet-base, two vertical side-walls, and two vertical end-walls. The pair of side-walls are rigidly secured to the pallet-base. The end-walls are secured to the pallet-base with a tongue and groove arrangement. The side and end wall extended plurality of members intermesh at the corner are secured by a vertical reinforcing post inserted from the bottom of the pallet-base up through the intermeshed corner members. A bottom end-rod secures the end-wall to the pallet and retains the corner posts. A reinforcing rod with end loops is molded inside the upper longitudinal portion of the double side-wall. A top reinforcing end bar inserted horizontally through the top corner side-wall interleave member and passed through the top of the inside of the double end-wall and the opposite top corner side-wall interleave and secured. The top horizontal reinforcing end bar engaged with the side-wall and molded-in side rod end loop provides internal reinforced structure protection against inward and outward forces at the corners and around the top perimeter in the critical area of abuse. The engagement of the top end bar and side rod end loop rests on top of the corner post to provide added vertical stacking strength for a stack of multiple bins. The center underside of the pallet-base has two parallel horizontal bars to limit center load sag where center load support is not otherwise provided.

19 Claims, 12 Drawing Sheets

REINFORCED DOUBLE-WALL KNOCK-DOWN BIN

CROSS REFERENCE TO RELATED APPLICATION

This application claims priority of Provisional Patent Application Serial No. 60/244,874 filed Oct. 31, 2000.

TECHNICAL FIELD

The present invention relates to material handling bins in general. More specifically to a bin that is fabricated of reinforced double-walled thermoplastic and is capable of being disassembled for storage and shipping.

Bin History

The General Forklift Handling Problem

Material handling by forklifts has always been the biggest problem affecting storage bin longevity, bin repair and bin replacement regardless of bin style and type. Customer supervision has been lax in demanding greater care and safety in the handling of all items by forklift operators. Also, the operators are driven by supervision to speed up the handling and moving of materials. Consequently, the "haste makes waste" caution goes out the window to meet schedules and/or cut labor costs by trying to do more with fewer operators thus resulting in serious damage by forklifts to buildings, pallet rack, floor mounted equipment, other forklift equipment, pallets, bins and a general hazard to other personnel.

Storage Bins in Industry

Large containers, that can be handled by a forklift, have generally been made of steel, wire, wood, corrugated paper (or combination thereof) and various versions of plastic, injection molded, structural foam, rotationally molded, vacuum formed and fluted plastic sheet. The Agriculture (AG) Industry, with the advent of fresh-cut packaged produce, has been forced to improve their handling of produce relative to the use of wood bins due to government regulatory agencies and consumer complaints of wood splinters and bacteria in edible products, some of which have resulted in illnesses, deaths and law suits. Wood bins cannot not be suitably sanitized.

The USDA has increased it's involvement in this industry similar to the meat and poultry industry establishing suitable standards for bacteria control. The AG industry has accelerated it's rate of conversion into using plastic containers as one of the alternatives to comply with government and consumer standards relative to elimination of wood splinters and sanitation. Individual companies are establishing control programs to secure certification of compliance by agencies that provide that service.

Wood bins are much stronger than plastic bins and will take a lot more abuse. In an effort to strengthen the wood bin in the forklift vulnerable areas of impact, the wood bin manufacturers resorted to adding galvanized sheet metal reinforcements nailed or bolted-on in the critical areas and large "U" shaped bolts to secure the panels to the corner posts. Consequently, in addition to the wood splinters and bacteria entering the vegetable process system the processors ended up with metal pieces falling off bins due to forklift damage and into processing equipment resulting in damaged machinery.

Metal detectors reject packaged product with metal particles. There is no suitable automatic means to detect wood splinters or bacteria, it has to be controlled by visual inspection and good processing procedures.

Plastic Bin Handling

The AG Industry fresh-cut processors' eagerness to convert to plastic bins was destined to happen. However, little attention was addressed to the necessity to retrain the forklift operators in the handling of plastic bins. Plastic bins introduced a whole new set of operating problems as they cannot be handled in the same way as wood bins. Plastic is slippery and the bins will slide off the forklift forks if the operator does not slow down. The longevity of the plastic bin concept was very short when they were introduced to the AG industry. Plastic bin replacement cost went up over wood cost not to mention the significant difference in initial cost of plastic bins compared to the wood bins being replaced. Also, labor cost went up because forklift operators had to slow down or lose the load.

Again, plastic bins are not as strong as wood bins and it is doubtful they ever will be. Plastic bins did solve the wood splinter problem and bacteria problem providing bins are routinely washed. Wood bins were rarely, if ever, washed.

Present Plastic Bin Market Review

Some of the manufacturers who make plastic bins are AC Buckhorn, Orbis, Macro, Arca(Perstorp/Xytec), Ropak, Carson, OTTO, Stratis, Nucon, Ultra Poly, Pacific Bin, Bonar Plastics, American Rotoform, RMI, and others.

Plastic Bin Designs

Some of the bin designs are (1) a one-piece single-wall bin where the legs are hollow, (2) a two-piece bin where the bin has a replaceable pallet base, (3) an injection molded structural foam collapsible bin where the bin is made up of five sections, a pallet, two sides and two ends that readily fold down or up, (4) a rotationally molded single-wall bin and a double-wall bin. Item (3) has gained popularity in that it is economical and parts can be easily replaced.

New Bin Features

Reinforced Double-Wall Knock-Down Bin

It appears the one-piece (or two-piece) bin is the least desirable. What customers prefer is a bin that has replaceable panels, is strong, has good longevity, low in-bound freight cost, at the lowest cost per bin. That is why the collapsible bin concept is so popular. My Reinforced Double-wall Knock-down Bin invention described below meets the requirements for greater strength and longevity and exceeds that of existing bins.

Bin Stack Fork Entry Target Area

The most critical area of forklift impact is the entry area where the fork tines must enter under the bin to lift it, move it, and stack it. This is the target area that is speared by the forklifts. The top of the entry way which is the bottom of the pallet deck, and the top of the bin which is the bottom of the entry way of two bins, receives a lot of force from forklift tine impact, by direct hit and/or fork drag. Entry way clearance height is limited to maximize the inside of the usable bin height for product volume. The overall bin height is restricted to suitability of fit for equipment and transporting and any increase in entry way height will reduce the inside height of the bin and volume of product the bin will handle. Forklift operators, when exiting and having stacked one bin on top of another bin, have a tendency to drop the fork tines down onto the top lip of the bin below placing a heavy drag load on the bin top lip. The result of this action will cause either one or both bin top corners to tear-out. This problem is compounded by AG industry use of special fork trucks designed to handle 12 (2 rows of 6) bins at a time.

If the terrain, where the 12 pallet fork truck is operating in, has an irregular floor surface and/or if all of the forks are not in perfect horizontal alignment with one another then some of the forks may create greater drag on the bin tops.

The thickness of the forks at the back of the tine almost takes up the clearance height between stacked bins and the clearance is considerably less if the bottom center of the bin sags due the load weight within the bin. Limited bin fork entry clearance, bin center load sag, and thick fork tines pose a serious maneuverability problem to the forklift operator.

DESCRIPTION OF THE PREFERRED EMBODIMENT

Figure 1:
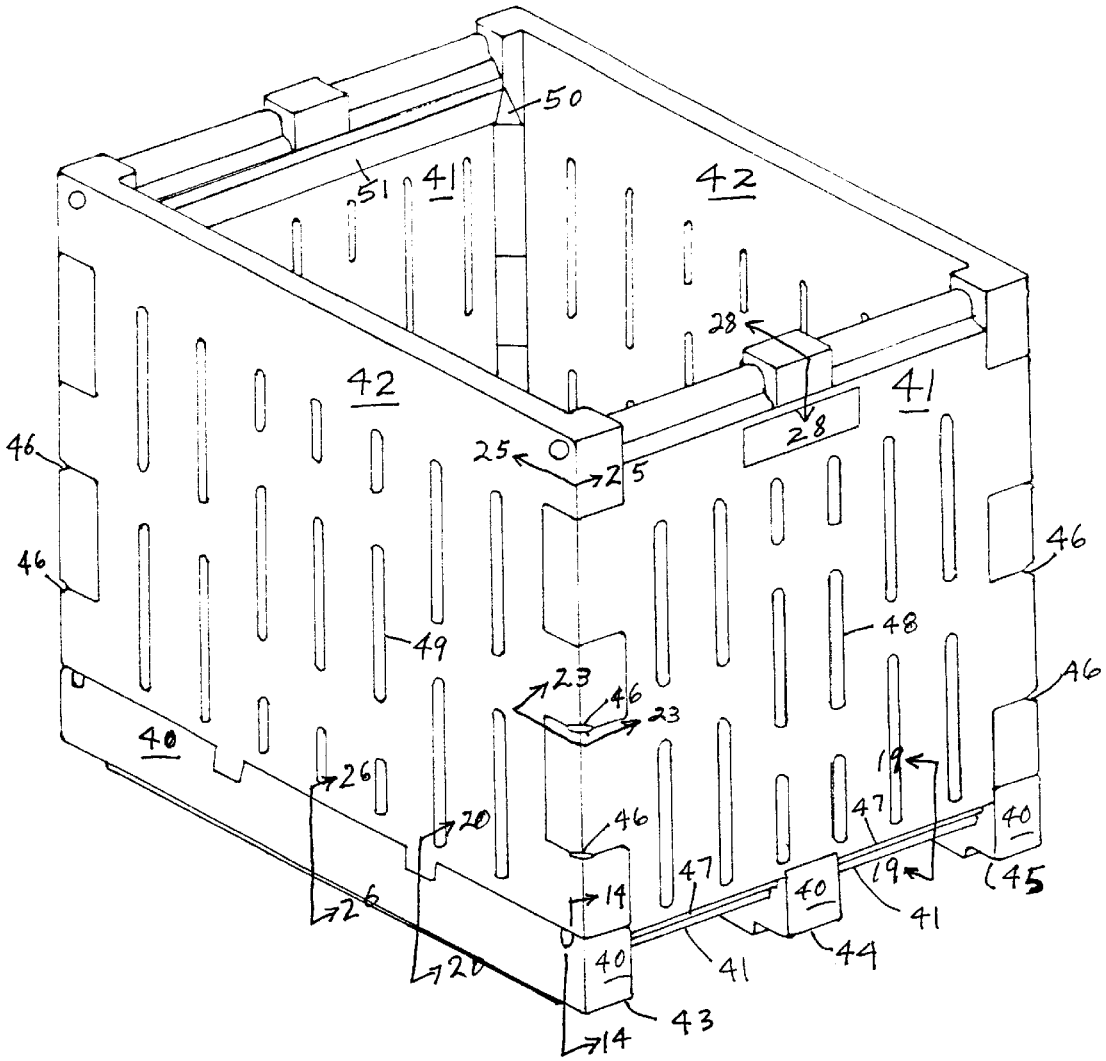
FIG. 1 is a perspective view of my reinforced double-wall knock-down bin in it's assembled condition.

The stackable reinforced bin shown in FIG. 1 is comprised of five primary double-wall rotationally molded plastic components. The double-wall sections are hollow and have a void in between the walls optionally filled with a foam material, defined as an expandable cellular plastic. This method of molding the components offers a lower mold cost and the structures by being double-wall provide added strength. A Linear Low Density Polyethylene resin is used to mold the sections of the bin because of it's flexibility and resilience to impact and is less likely to fracture and crack than other types of materials. However, any type of resin suitable to rotational molding process could be used for other applications. The pallet-base 40, and two identical vertical end-panels 41, and two identical vertical side-panels 42 form the enclosure bin. Although the pallet-base 40 is shown in FIG. 1 as a two-way forklift entry from either end of the bin it is possible to also have the same configuration on the side so as to provide four-way forklift entry which is not illustrated.

Figure 8:
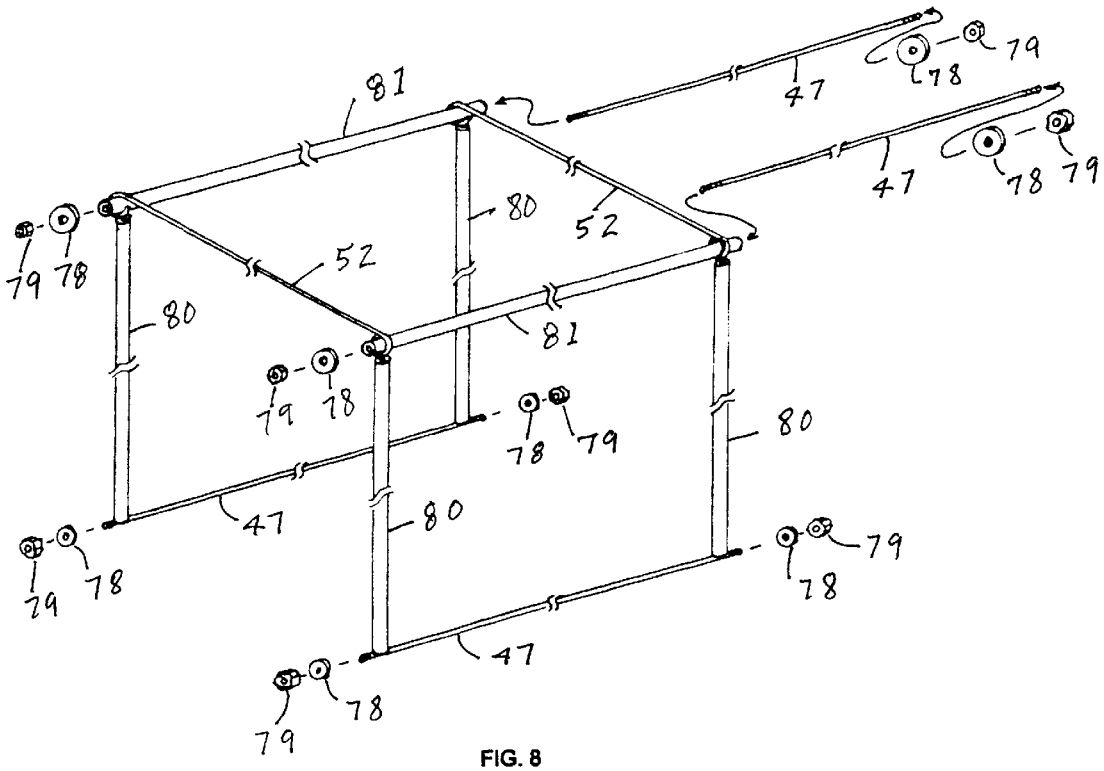
FIG. 8 is an isometric view of the internal reinforcing support structure confined within the walls of the bin in FIG. 1.

The internal supporting reinforcing structure shown in FIG. 8 provides substantially increased strength to the structure of the primary components and is composed of two bottom end rods with threaded ends 47 preferably metal however a strong plastic material could be substituted, four vertical corner posts 80 which are tubular but could be solid preferably plastic however could be metal for added strength, two top horizontal side rods with loop-ends 52 preferably made of metal which are molded into the top side-panel 42, and two top horizontal end bars 81 preferably made of plastic but could be made of metal with two horizontal end rods 47 preferably made of metal but could be made of plastic that are inserted into the end bars 81 and have threaded ends. Each side-panel 42 have a plurality of bottom male extensions and the pallet-base 40 has a number of female receptacles. The bottom male extensions engage within the female receptacles in the pallet-base 40 and each side-panel 42 includes a segmented horizontal end extension on opposite ends. These side-panels have segmented extensions on opposed ends engaging with said end-panel segmented horizontal extensions, and the end-panel and side-panel corner extensions each having at one opening on top and one opening on bottom, which concentrically match in perpendicularity. The end-panels 41 and the side-panels 42 have a series of molded-in vent slots, typically 48 & 49 shown in FIGS. 1, 2, & 3 respectively which not only provide ventilation for products placed in the bin that require air circulation such as produce, but also provide additional strengthening to the panels.

Figure 7:
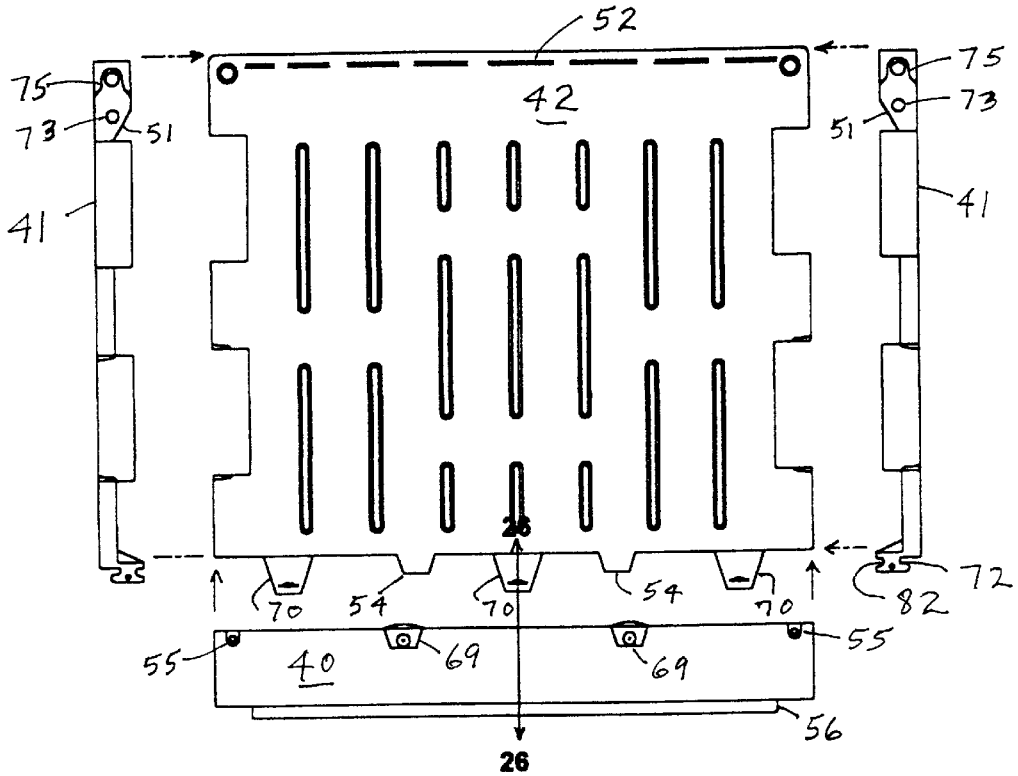
FIG. 7 is an exploded side elevation view of the bin in FIG. 3 showing the assembly direction of the end panels and pallet attached to the side panels.

The end-panel 41 and side-panel 42 vent slots show the center group of vent slots at 48 & 49 configured in the center of the panels so that the center of the wall is strengthened in the longitudinal direction to reduce the possibility of outward wall bowing due the outward force of the product loaded inside the bin. The top portion of the end panel wall 41 is thicker than the lower major portion of the wall as shown in FIG. 1 & FIG. 7, the purpose of the slope 51 on the inside of the end-panel 42 at the top as shown in FIG. 1 is to provide the transition to the narrower section below. In order for the inside wall of side-panel 42 to blend in with this transition on the top inside corner of the sidewall 42 at 51 is configured to blend in with this slope.

Figure 2:
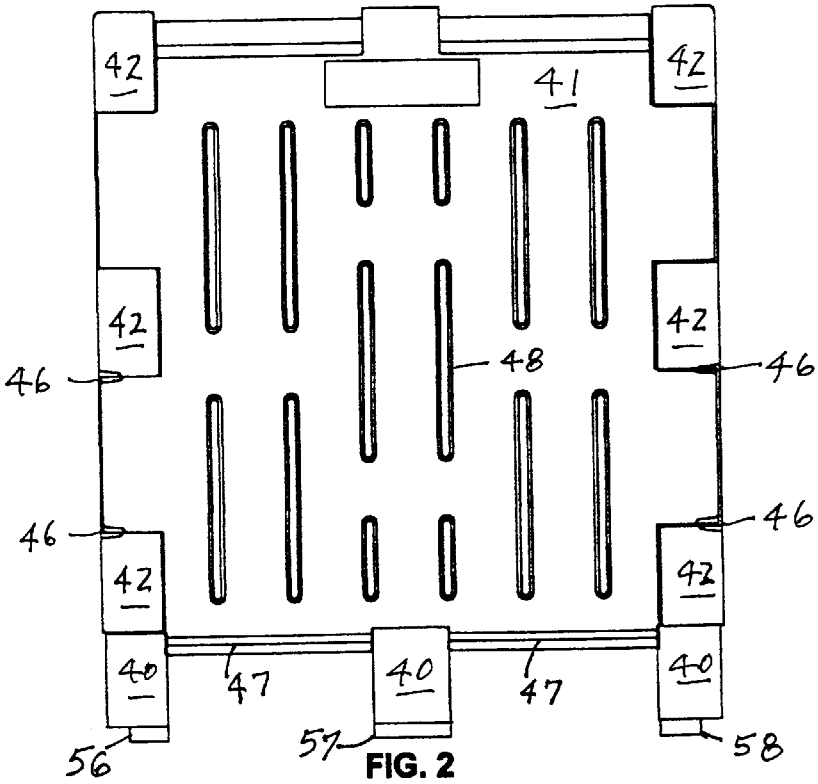
FIG. 2 is an end elevation view of the bin in FIG. 1.
Figure 5:
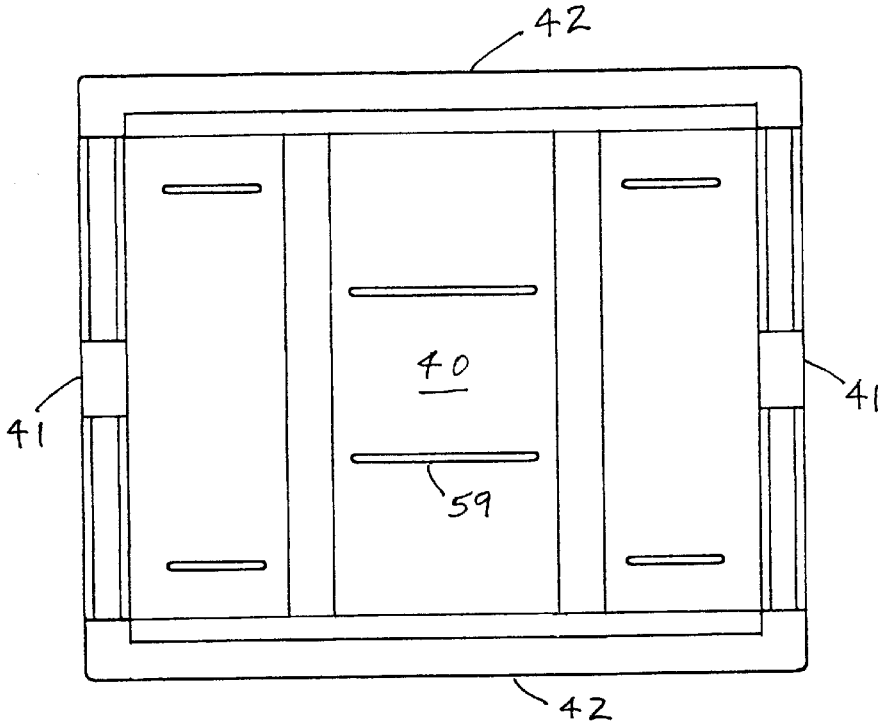
FIG. 5 is a plan view of the top of the bin in FIG. 1.

The pallet-base 40 shown in FIG. 2 is provided with inward stepped sections on the bottom of the legs, on the full length of the left outer leg 56, the ends of the center leg 57 and the full length of the right leg 58, to provide positive stacking inter-lock where this recessed section on the bottom fits into the top of a bin when one bin is stacked on top of the another bin.

Figure 3:
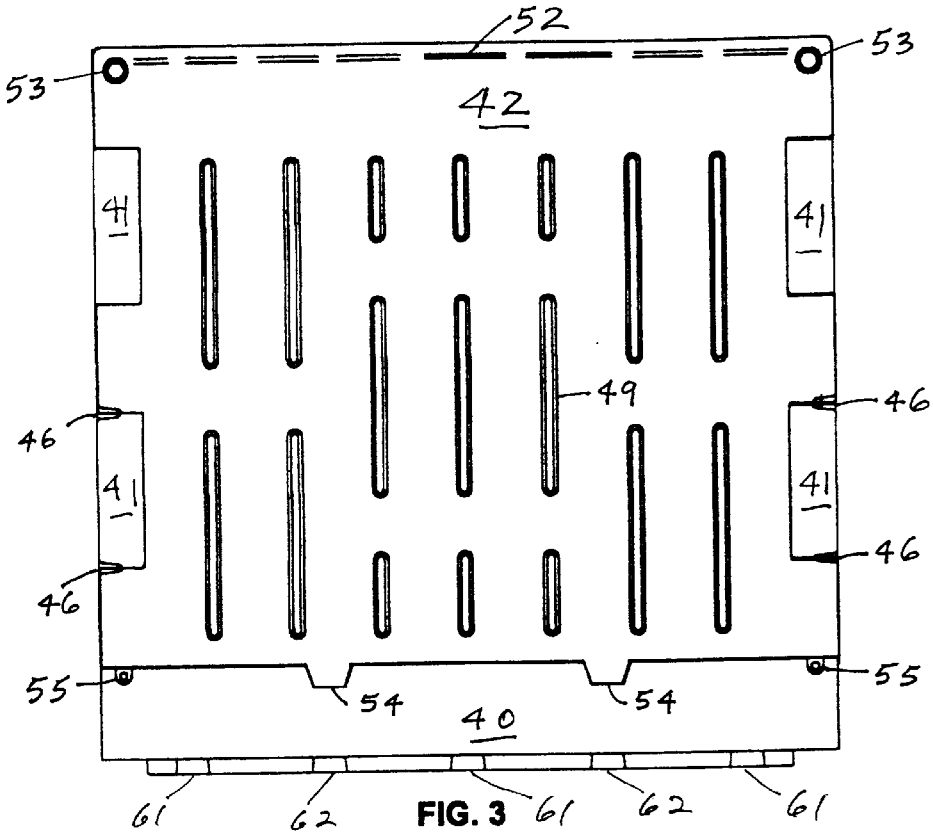
FIG. 3 is a side elevation view of the bin in FIG. 1.
Figure 10B:
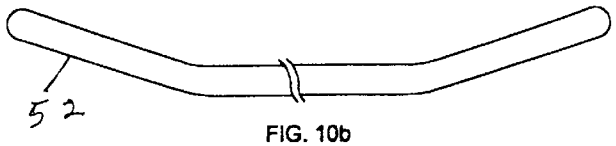
FIG. 10*b* is a top plan view of the loop of FIG. 9 showing an alternate forming of the loop-end.
Figure 10A:
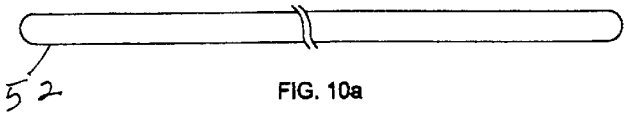
FIG. 10*a* is a top plan view of the loop-end of FIG. 9 showing it in straight form.
Figure 9:
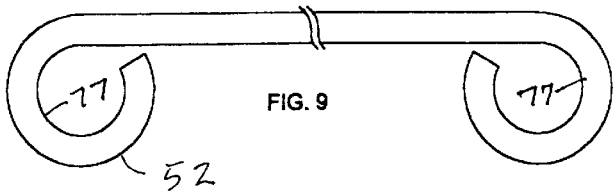
FIG. 9 is an elevation view of the loop-end tie rod shown in FIG. 9 that is molded-in the top portion of each side panel shown in FIG. 3 & FIG. 7.

The top of the side-panel 42 shown in FIG. 3 has a molded-in metal rod with loop ends 52 to provide substantial strength to the top side wall and increase the rigidity along the top to reduce the flexibility in of the plastic wall in this area. Plastic by itself is not as rigid as metal or wood. The loop end 77 of side rod 52 shows the preferred configuration of the loop which must accommodate the diameter of the top end bar 81. FIG. 10*a* straight form & FIG. 10*b* alternate with FIG. 10*b* being the preferred shape show the top view of the loop end side bar 52 which could be either straight or bent at an angle as shown.

Referring to FIG. 14 through FIG. 19, end-panel 41 has a first means for securing the bottom end of the end-panel 41 to the end of the pallet-base 40 with a plurality of horizontal tongues 71 on the end of the pallet-base which engage with a first set of corresponding horizontal grooves 82 on the bottom inside wall of the end-panel 41. The end-panel 41 has a second means for securing end-panel 41 to the pallet-base 40 with a second set of horizontal grooves 72 on the outside of end-panel 41 bottom end directly opposite the first set of grooves 82. The end-panel is fully secured to the pallet-base 40 with the insertion of an end rod 47 alternately through each pallet-base 40 leg end openings 84 shown in FIG. 15 through 18 concentrically matched with the second set of horizontal grooves 72. Fastening means attached to opposed ends to the threaded end rod 47 secure the rod. Each end-panel 41 has a plurality of corner extensions, which engage the side-panel 42 segmented horizontal end extensions on opposing ends. The end-panel 41 corner end extensions have at least one opening top and bottom that concentrically match in perpendicularity. Each side-panel 42 and end-panel 41 have means for holding together a corner point. The corner point consists side-panel 42 extensions and end-panel 41 extensions that inter-mesh. Openings in the horizontal end extensions of the side-panel 42 and end-panel 41 corner extensions inter-mesh vertically and concentrically.

Figure 32:
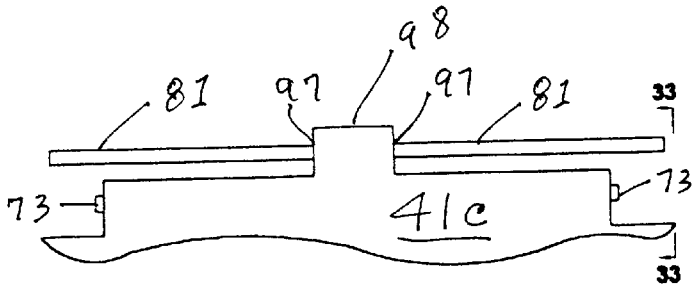
FIG. 32 is a partial elevation view of the top of end panel showing a second alternative option of the preferred configuration of FIG. 28.
Figure 33:
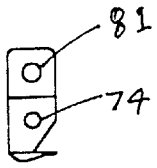
FIG. 33 is an end view of FIG. 32.
Figure 28:
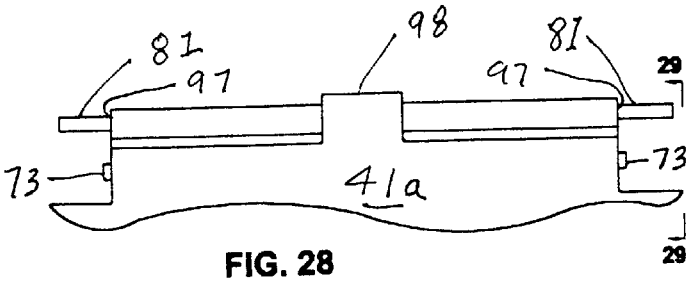
FIG. 28 is a partial elevation view of the top of the end panel showing the preferred configuration of FIG. 6.

An alternate top configuration to the preferred embodiment shown in FIG. 28 is illustrated in FIG. 32 which consists of the end-panel 41*c* horizontal top end having a cut out on opposite sides of the end-panel 41*c* area in a center portion thereof forming a stacking land 98 for the pallet-base 40 center leg underside end. This cutout permits stacking a bin on top of another bin thereby exposing the top end bar 81 horizontally on opposite sides of the end-panel 41*c* top center 98 thus reducing possible damage to the forklift access bin to area of the end-panel 41.

Figure 4:
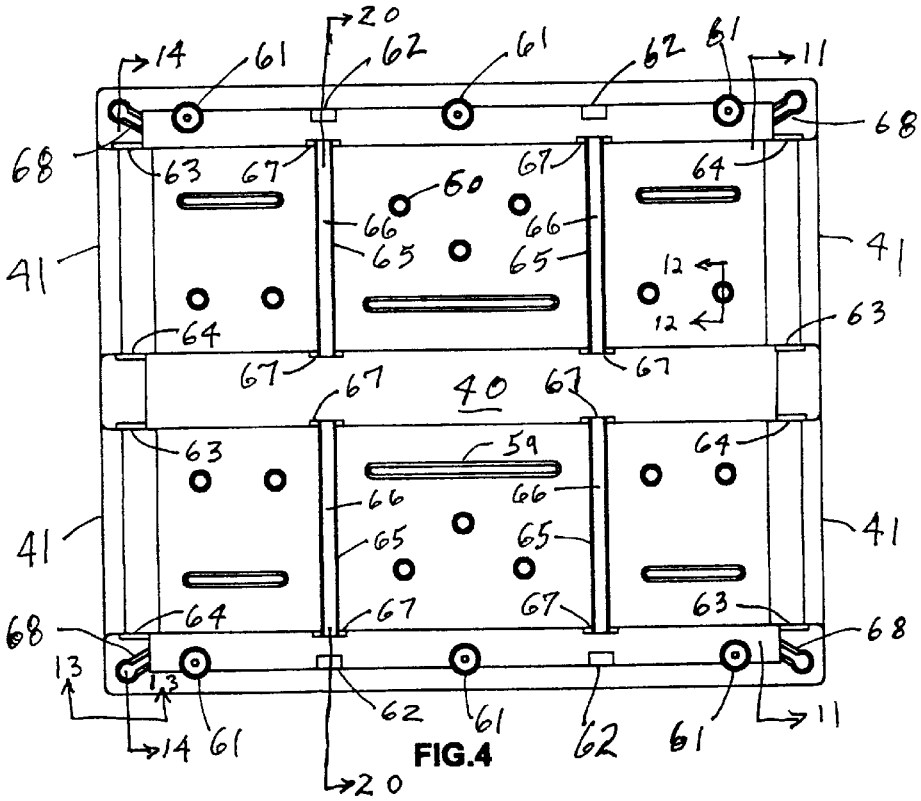
FIG. 4 is a plan view of the bottom of the pallet of the bin in FIG. 1.
Figure 12:
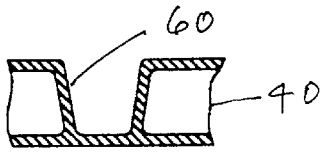
FIG. 12 is a cross section elevation view of line 12—12 in FIG. 11 of the typical recesses in the bottom of the pallet.

The pallet-base 40 has a plurality of molded-in reinforcing recesses 60 on its underside as illustrated in FIG. 4. The recesses 60 are perpendicular to the pallet-base 40 bottom walls as shown in FIG. 12 and are joined at the top of the underside of the pallet-base 40 top wall providing substantial reinforcing strength to the pallet-base 40 bottom surface to aid in the support of the load within. The pallet-base 40 shown in FIG. 4, includes two horizontal channels 65 on an underside surface between the outer leg and center leg of said pallet-base 40. The channels 65 are spaced and centered to provide distributed load support of the load within the bin. To further explain the function of the channels 65, they are recessed within the profile of the pallet-base walls which strengthen and accommodate the support bars that ultimately support the load.

Figure 20:
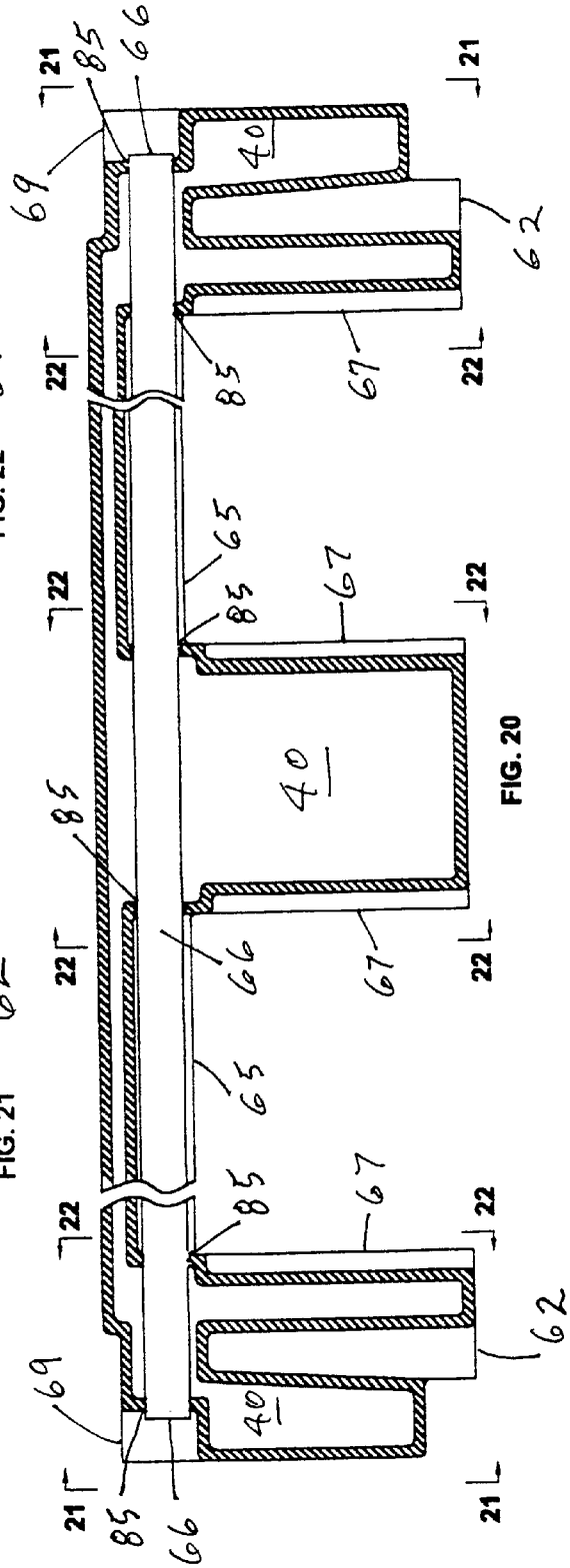
FIG. 20 is a cross section elevation view of line 20—20 of FIG. 1 of the pallet showing the two outer pallet legs and the center leg with the load support bar.

The pallet-base 40 shown in the cross section view FIG. 20, has a plurality of openings 85 in the sidewalls of the underside legs with the pallet-base 40, support bar 66 made of a metal tube having a predetermined length, is inserted into openings 85 and channels 65. Retaining means comprise a plurality of predetermined extensions 54 at the bottom outer of the side-panel 42 having a suitable size for engaging recesses 69 in the pallet-base 40. The extensions 54 close off the support bar 66 insertion opening 69 within the pallet-base when the side-panel 42 is assembled to the pallet-base 40. The pallet-base 40 has a plurality of reinforcing vertical gussets 62 & 67 on the leg walls to add additional to the load The pallet-base 40 to includes a plurality of receptacles 96, depicted in FIGS. 26 & 27 which form an upper tapered conical structure to accommodate receiving the side-panel 42 bottom tapered extension 70. Female fastening means 88 are integrally connected to a corresponding vertically concentric downward oppositely tapered conical structure 96 on the underside of the pallet-base 40 outer legs. This arrangement accommodates insertion of male fastening means 92 from the underside of the pallet-base 40. The combination of tapered inverted vertical concentric conical structures 96 provide substantial reinforcing strength.

The bottom of the pallet-base 40 shown in FIG. 4 has have means for ventilation consisting of a series of molded-in vent slots 50 to provide air circulation and added strength to the double-wall of the pallet-base 40. The strength of the bottom double-wall pallet-base 40 is further increased by the addition of several recesses 60 which are shown as circular but could be any configuration and are further illustrated along line 12—12 in FIG. 12. The bottom of the pallet-base 40 shown in FIG. 4 has two horizontal tubes support bars 66 inserted in the channels 65 and the outer legs and center leg to provide substantial added strength to the bottom center of the bin to minimize the possibility of sagging or downward deflection due to the product load within in the bin. In a stack of two or more bins the bottom bin is resting on the ground or floor surface and the load is distributed along the bottom of all three legs. However, when two or more bins are stacked one on top of the other the center section of the center leg is unsupported leading to the possibility of load sag which will impede the ability of a forklift to pick up the upper bins.

Figure 6:
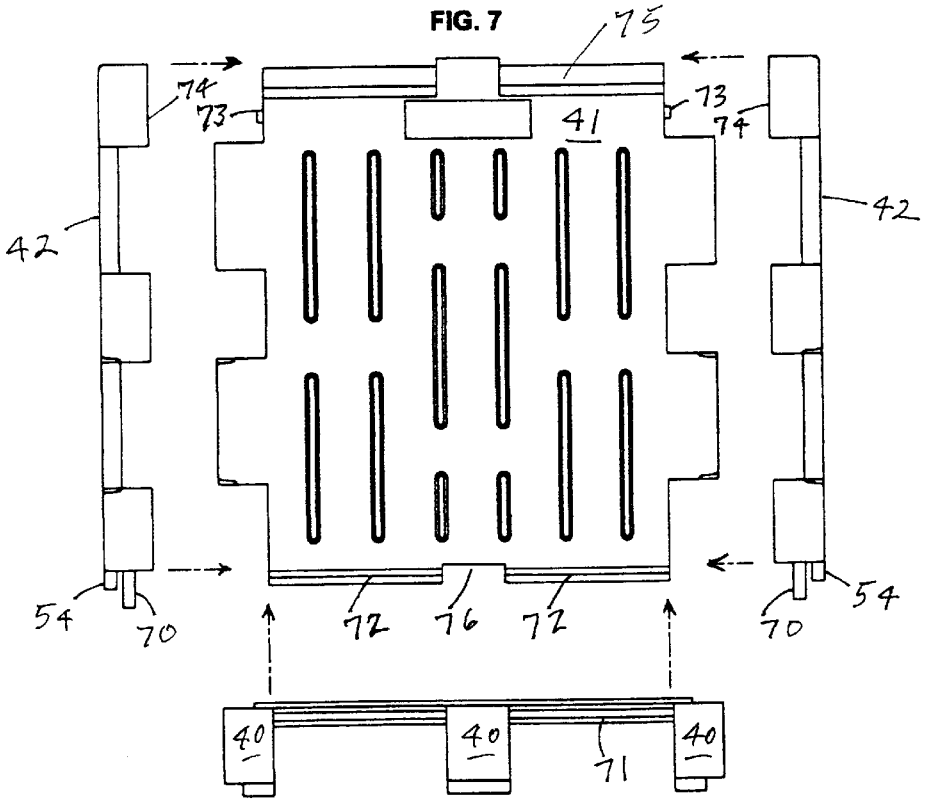
FIG. 6 is an exploded end elevation view of the bin in FIG. 2 showing the assembly direction of the side panels and pallet attached to the end panels.
Figure 23:
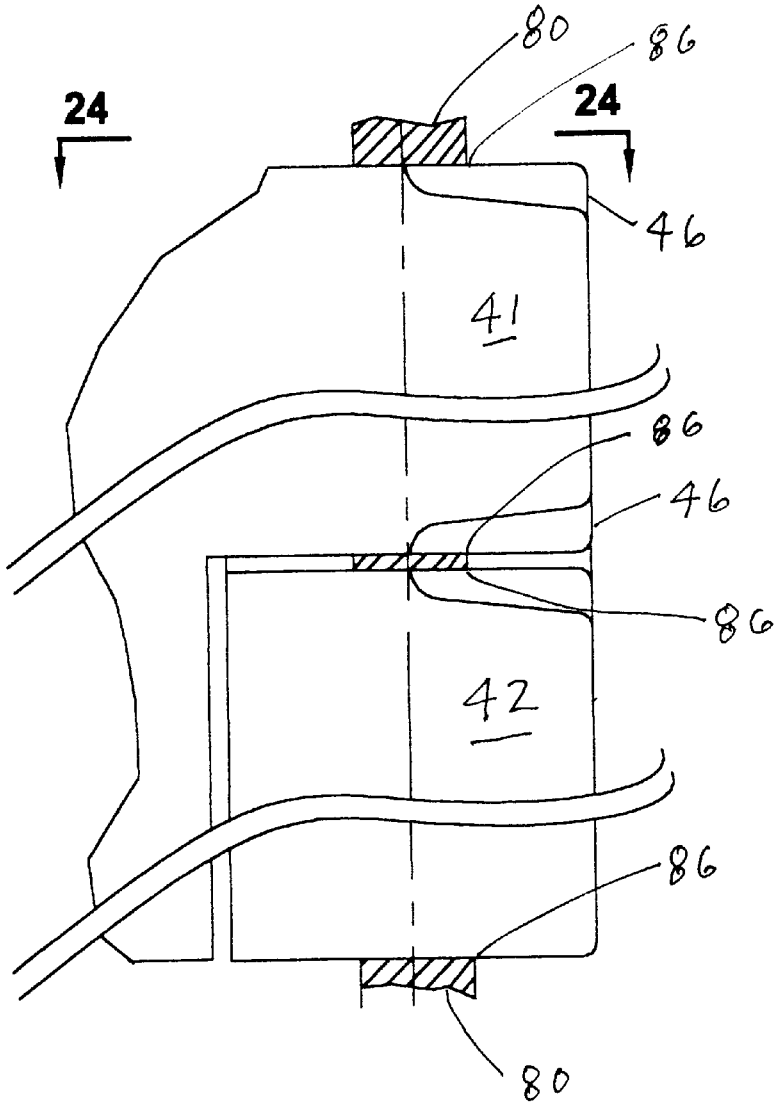
FIG. 23 is an enlarged partial elevation view of the corner end of the side panel and end panel interleaved showing the formation of the corner notch along line 23—23 of FIG. 1.

The method of bin pre-assembly shown in FIG. 6 is to move the two side-panels 42 toward the end-panels 41 until the corners are inter-meshed with one another. These panels are held in place by the four corner posts 80 shown in FIG. 8 by inserting the posts through holes 86 in the top and bottom of each panel corner member as shown in FIG. 23 and pallet-base 40 corner opening 68, shown in FIG. 13, from the bottom upwardly. Pin projections 73 on the top ends of the end-panels 41 engage with the holes or recesses 74 in the top end of the side-panels 42. The pallet-base 40 is then moved upward to engage the end-panels 41 and side-panels 42. The bottom end rods 47 are then inserted form either side into the hole 84 located in recess 55 of the pallet-base 40 in FIG. 15 passing through the end of the left outer leg of pallet-base 40 then the bottom end rod 47 lays into the channel first groove 72 provided at the bottom of the end-panel then the bottom end rod 47 passes through the center leg end 40 and lays into the bottom second groove 72 of the end panel 41 and finally the bottom end rod 47 passes through the right outer leg of the pallet-base 40 which now secures the corner posts 80 from falling out FIG. 13 and secures the end-panels 41. Pre-assembly FIG. 7 shows an end view of the grooves 72 at the bottom of the end panel 41. The three tabs 70 at the bottom of each side-panel 42 shown in FIG. 7 engage into correspondingly contoured recesses 96 shown in FIG. 26 on the top of the pallet-base 40. The two tabs 54 at the bottom of the side-panel shown in FIG. 7 engage with the recesses 69 to secure the support bars 66 shown on FIG. 4 to prevent support bars 66 from coming out. An underside pallet-base 40 corner outer leg opening 68 in FIG. 13 has a parallel key-slot access channel which enables insertion of an elongated long nose pliers to grab onto the bottom end of the corner post to extract the corner post to facilitate component replacement.

Figure 25:
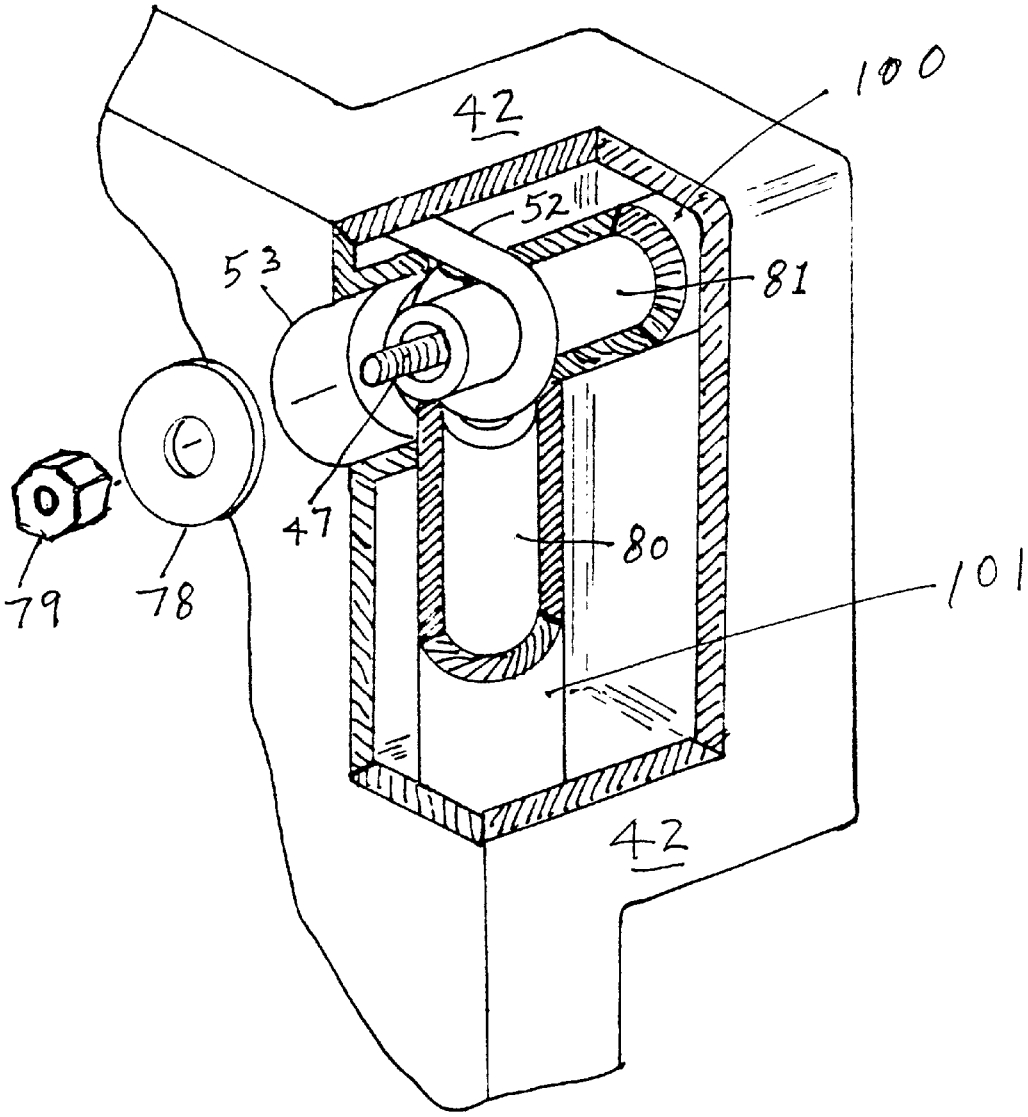
FIG. 25 is an isometric cross section of the top corner along line 25—25 of FIG. 1.

The horizontal top end bar 81 is inserted into the molded-in hole 100 in the top corner of the side-panel 42 shown in FIG. 25 and then passed through the holes in the top of the end-panel 41 and then finally through the molded-in hole 100 on the opposite side-panel 42 as shown in FIG. 25. The end rod 47 has end fastening means 79 disposed on each end to allow concealment of end fastening means within a profile of said side-panel. The horizontal top threaded end rod 47 is inserted into the full length of the top end bar 81 thereafter the fastening means, preferably, but not limited flat washers 78 and lock nuts 79 are attached to secure the top corners. This will be described in further detail.

Figure 11:
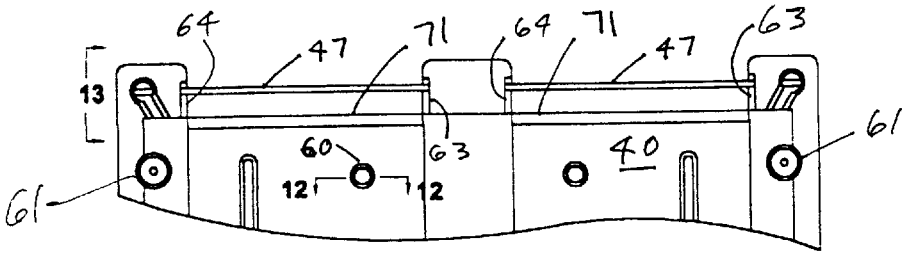
FIG. 11 is a partial plan view of one end of the pallet bottom showing the tie-rod installed, the end panels are not shown.

One end of the bottom plan view of the pallet base 40 is illustrated in FIG. 11 without the end-panel 41 installed to show the horizontal bottom threaded end rod 47 inserted through the three pallet legs. Convolutions 63 & 64 illustrated in FIG. 16 & 17 respectively provide additional support to the end rod 47. The front edge 71 of the pallet-base 40 between the outer legs and center leg is the tongue portion of the tongue and groove engagement illustrated in FIG. 19. The cross section elevation view of the strengthening recess 60 along line 12—12 is illustrated in FIG. 12.

Figure 13:
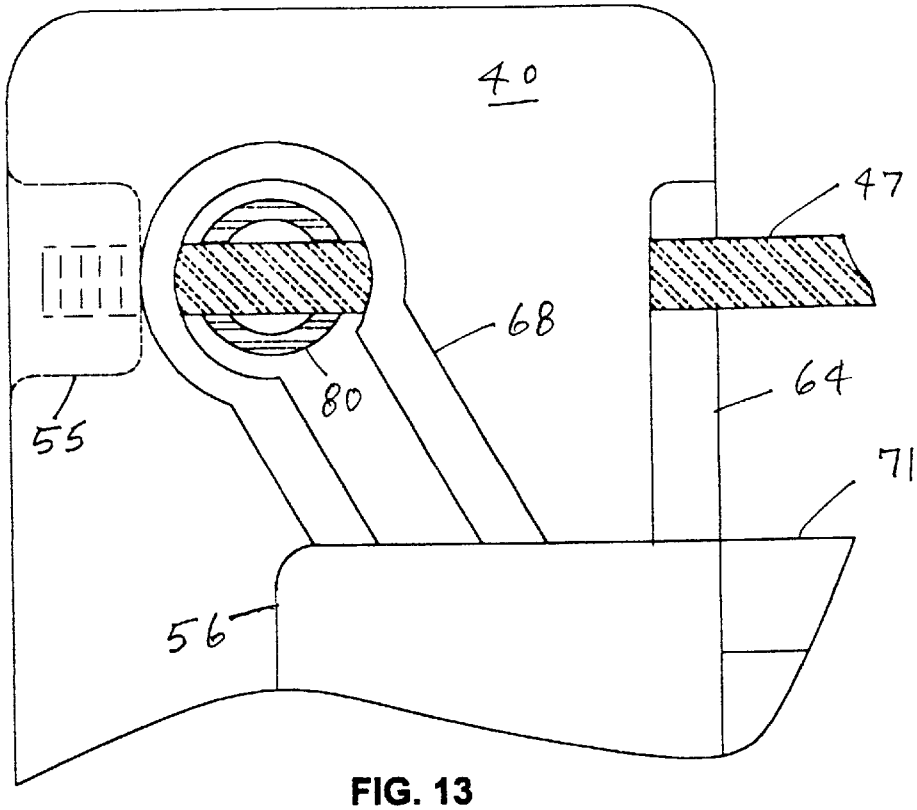
FIG. 13 is an enlarged partial plan view of line 13—13 in FIG. 11 of the left corner end of the bottom end of the pallet.
Figure 14:
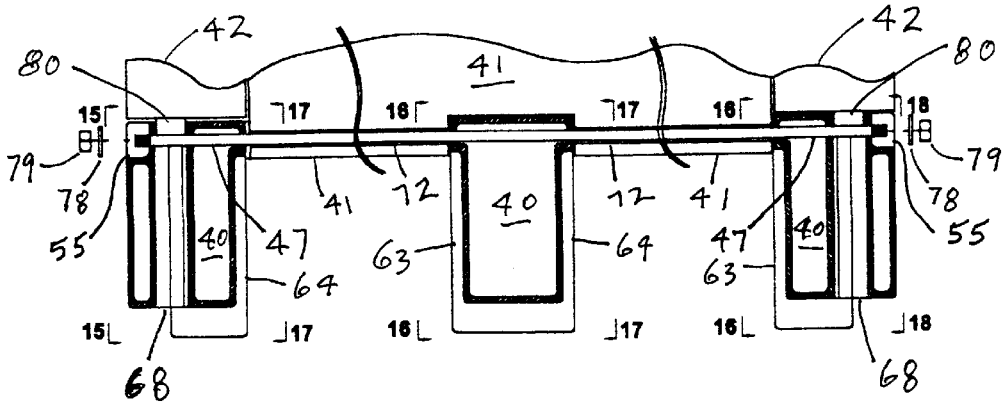
FIG. 14 is a cross section elevation view of one end of the pallet base of the bin in FIG. 1.

The exploded partial plan view of the left outer leg corner of pallet 40 along line 13—13 is illustrated in FIG. 13. End rod 47 inserted into the leg of pallet-base 40 shows where the corner post 80 is secured from coming out of the opening 68. The threaded end of the end rod 47 extends into the recessed area 55 so that when the flat washer 78 and lock nut 79, shown in FIG. 14, are installed they will not extend beyond the outer wall of pallet-base 40 surface. The indented step 56 of pallet 40 provides the positive stacking. The key slot in corner opening 68 will accommodate an elongated "Long-Nose" pliers to enable easy removal of the corner post 80 when it is necessary to replace either the end-panel 41 or side-panel 42.

A cross sectional elevation view of one end of the pallet-base 40 along the line of 14—14 in FIG. 4 is illustrated in FIG. 14, described in detail earlier. Means for supporting a load within the bin at the pallet-base when a bin is stacked on top of another consists of strengthening convolutions 63, 64 & 68 that provide additional load support which is directed to the base of the pallet 40. Flat washers 78 and lock nuts 79 are installed in the recesses 55 to retain the end rod 47 in place. The end rod 47 rests inside the end-panel 41 channel 72 which is between the legs of pallet 40 to secure the end-panel 41 in place. The hole 84 shown in the partial elevation views of the pallet 40 leg ends in FIG. 15 through FIG. 18 accommodates the end rod 47.

Figure 19:
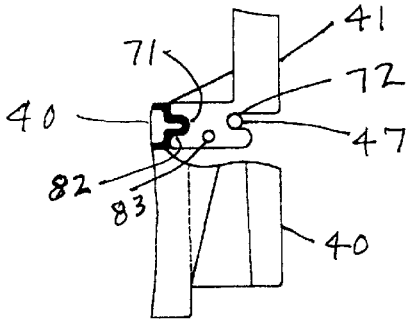
FIG. 19 is a cross section elevation view of line 19—19 of FIG. 1 of the pallet end showing engagement of the end panel groove with the pallet tongue and the tie-rod.
Figure 15:
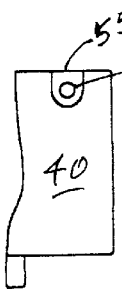
FIG. 15 is an end outside elevation view of line 15—15 of FIG. 14 of the left side of the pallet end outer-leg.
Figure 16:
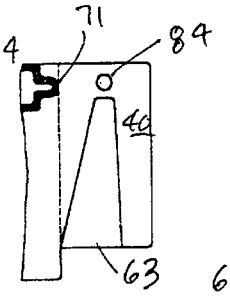
FIG. 16 is an end inside elevation view of line 16—16 of FIG. 14 of the left side of the center-leg and the inside of the outer-leg on the right of the pallet end.
Figure 17:
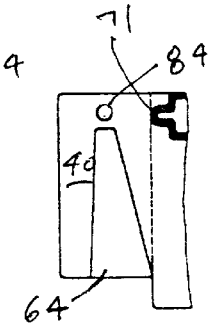
FIG. 17 is an end inside elevation view of line 17—17 of FIG. 14 of the right side of the center-leg and the inside of the outer-leg on the left side of the pallet end.
Figure 18:
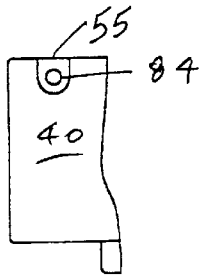
FIG. 18 is an end outside elevation view of line 18—18 of FIG. 14 of the right side of the pallet end outer-leg.

A partial plan view of the pallet taken along line 19—19 in FIG. 1 is illustrated in FIG. 19 showing the end-panel 41 engaged with the pallet 40 end using the tongue & groove method. The pallet-base 40 has a set of horizontal tongues and the end-panels 41 have a first set of horizontal grooves which engage with the tongues, a second set of grooves opposite said first set of grooves allows the bottom end rod to pass horizontally through said second set of horizontal grooves securing the end-panel 41 to the pallet-base 40. Hole 83 shown in FIG. 19 is drain hole to prevent moisture from being trapped in between the walls of the end-panel 41.

Figure 22:
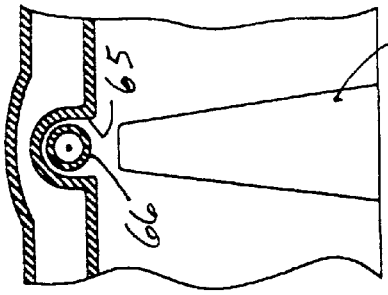
FIG. 22 is a partial inside elevation view of the sides of the center leg and outer legs along line 22—22 of FIG. 20.
Figure 21:
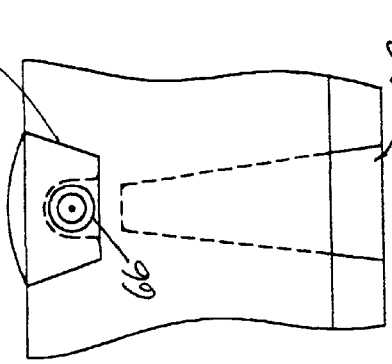
FIG. 21 is a partial outside elevation view of the sides of the outer legs along line 21—21 of FIG. 20.

A cross sectional elevation view FIG. 20 taken along line 20—20 of FIG. 1 illustrates the center load support at the bottom of the pallet-base 40. The support bar 66 inserted at either side of the pallet 40 through hole 85 in the recess 69 and is passed through all of the holes 85 until it is centered. The support bar 66 fits into the open channel 65. The support bar 66 is substantially supported by the vertical convolutions 67 and 62 which distributes the load to the bottom of the pallet-base 40. The elevation view FIG. 21 is an exploded view of the pallet-base 40 side in FIG. 3 which illustrates the recess 69 to accommodate the tab 54 on the side-panel 42 which secures the support bar 66 from coming out of either side. The exploded partial elevation view FIG. 22 is a cross section illustration of the channel way 65 for the support bar 66 and the support gusset 67.

A number of vertical gussets, 63, 64, and 68 are located in vertical side walls of the pallet-base 40 legs under the openings 84 for insertion of the bottom end rod 47 thereby providing substantial reinforcement to the bottom end rod.

The side-panel 42 corner members and the end-panel 41 end members are inter-meshed as shown in exploded partial elevation view along the line 23—23 of FIG. 1 illustrated in FIG. 23 which provides substantial stacking strength in four corners of the bin assembly in FIG. 1 and the corner members are secured by the corner post 80 inserted from the bottom up through all of the holes 86. A corner notch 46 is formed by the inter-meshed configuration of the outer vertical edge of the corners of end-panel 41 and side-panel 42 as illustrated in FIG. 23 which provides a means for holding a tie-down rope in place to explain, in the process of field harvesting produce, two rows of 6 bins per row are placed on top of an over-the-road flat bed trailer and in order to secure the bins from sliding off the trailer in transit a rope is tied to the trailer front vertical rack, bought back horizontally to the rear of the trailer and then placed across the back of the load placed downward diagonally to the opposite end of the trailer on the rear and secure to the trailer frame, the same is done on the other side without the notches 46 to keep the tie-down rope in place the rope would slide down the corner and create an unsafe load for transporting.

Figure 24:
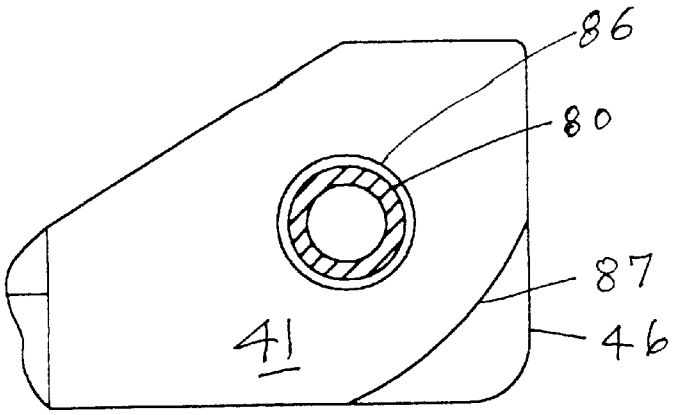
FIG. 24 is a partial section top plan view along line 24—24 of FIG. 23.

The tie-down ropes are horizontal on the side and diagonally cross one another in the rear of the load. FIG. 24 illustrates a top plan view along line 24—24 of FIG. 23 showing the corner post 80 inserted in hole 86 in the center of the corner member. The exploded isometric cross sectional view of FIG. 25, taken along the line 25—25 of FIG. 1 illustrates the substantial strength of the combination of all parts coming together at one point. The top corner of the side-panel 42 illustrates the vertical corner post held in place by molded-in hole 101 of the side-panel 42 and contacting the bottom of the molded-in side rod 52 to provide substantial corner stacking strength. Further, the horizontal top end bar 81 coming from the end-panel 41 is supported by the molded-in hole 100 and is substantially secured in place by the loop end of the side rod 52. Further, the top end rod 47 is locks the corner assembly by the placement of the flat washer 78 and lock nut 79 in the recess 53. This arrangement provides the ultimate assurance the top corners of the bin will not be broken by the action of a forklift dragging the fork tines across the top of the bin while exiting after having placed a bin load on top of another bin. The bin load will add to the support of the bin in any attempt of the forklift operator to destroy the top corners of the bin even with the fork tines tilted downward short of the operator's malicious attempt to cause damage.

Figure 26:
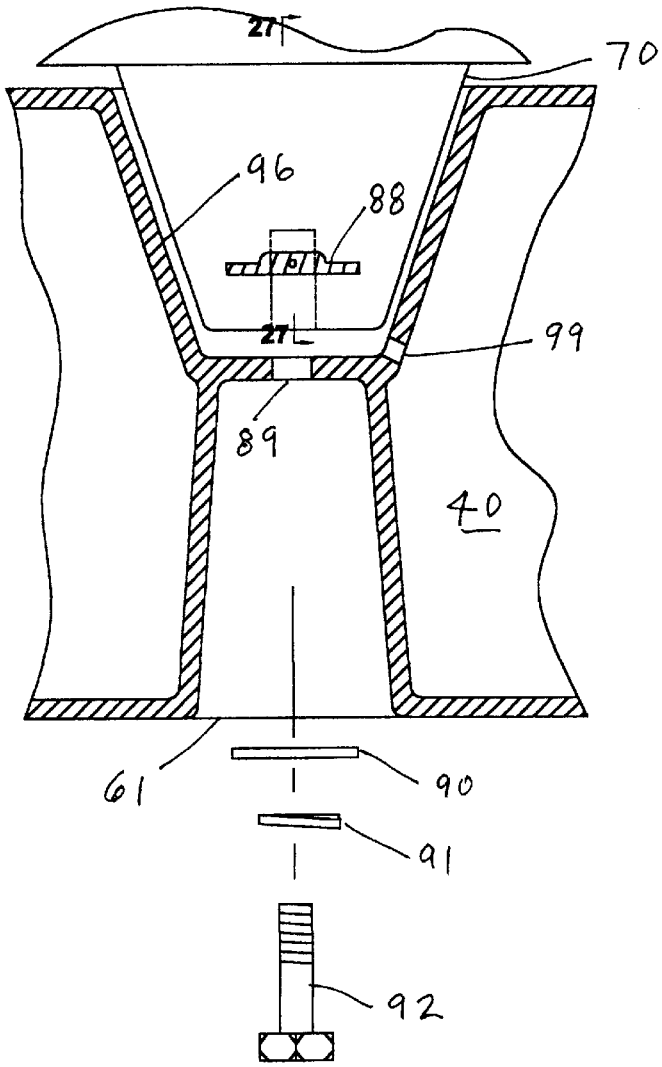
FIG. 26 is a partial cross section elevation view of the side of the pallet and side panel engagement of the side panel bottom tab into the socket on top of the pallet along line 26—26 of FIG. 7.
Figure 27:
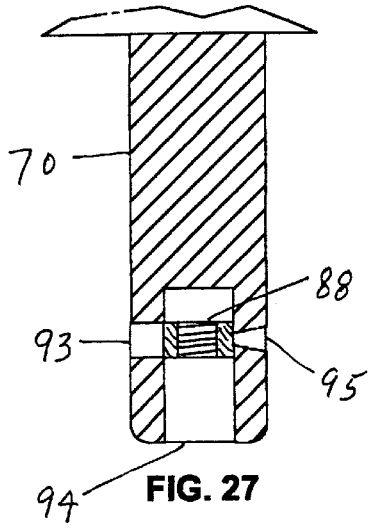
FIG. 27 is a cross section elevation view along line 27—27 of FIG. 26.

The pallet-base 40 has three conical female receptacles 96 on the top surface of each side with an access port 61 below as illustrated in cross sectional plan view of FIG. 26 typically taken along the line of 26—26 in FIG. 1. The receptacle 96 on top accommodates the side-panel 42 bottom tab 70. The tab 70 has a socket 93 as shown in FIG. 27 taken along line 27—27 of FIG. 26 to accommodate a tab weld nut 88 with a snug fit to keep it from falling out before the side-panel 42 is assembled. The vertical hole 94 in the bottom of the tab 70 is to allow the insertion of the bolt 92 to engage with the nut 88. In the event the threads of the nut 88 become defective the nut 88 can be extracted by using a common punch placed into the knock-out port 95 and replace the nut 88. The bottom of the pallet-base 40 has an access port 61 to enable the insertion of a flat washer 90 and a lock washer 91 over the bolt 92 to secure the side-panel 42 to the pallet-base 40 at three locations on each side. The conical receptacles 61 and 96 provide substantial load support to the bottom of the pallet-base 40.

Now the complete bin assembly has been completely secured in all respects. If it becomes necessary to replace one end-panel 41 that has been damaged all that is needed is to remove the lock nut 79 and flat washer 78 on one end of the bottom end rod 72, slide the rod 72 out, use a long-nose pliers inserted into the corner opening 68 on the under side of the pallet-base 40, grab the corner post 80 and slide it out of each end of the end-panel 41 and remove the defective panel and install a new panel and replace all of the parts removed. To replace a side-panel 42 the same procedure would apply as previously described but it is only necessary to slide the end rods 47 just enough to extract the corner posts 80 then remove the three bolt 92 assemblies. Also, the two top corner end rods 47 will have to be disengaged as well. The most vulnerable part of the bin to being damaged is the entry end so the end-panel 41 will most likely require frequent replacement.

Figure 30:
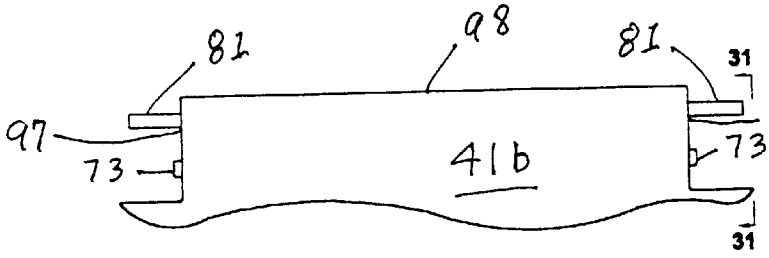
FIG. 30 is a partial elevation view of the top of end panel showing an alternate option of the preferred configuration of FIG. 28.
Figure 31:
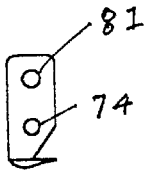
FIG. 31 is an end view of FIG. 30.
Figure 29:
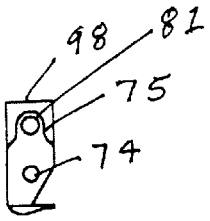
FIG. 29 is an end view of FIG. 28.

The top of the end-panel 41 has three top configuration options as shown in FIGS. 28, 30 & 32. The configuration shown in FIG. 28 is the preferred form in that the top sections of end-panel 41*a* on either side of the flat stacking land 98 are contoured 75, shown in FIG. 29, to form the plastic wall closely over the top end bar 81 which not only offers a slight increase in space above the top horizontal surface to make it easier for the forklift to move the fork tines in and out between two stacked bins but it also provides less chance of the fork tine puncturing the plastic wall of the end panel 41 because the plastic wall will be supported by the close proximity of the end bar 81 should the operator err in attempting to move into the target area for loading or unloading. The mold will be made with removable sections to provide the other options in FIGS. 30 & 32 for applications that warrant either one of the two configurations. Option 41*b* shown in FIG. 30 provides maximum cube utilization of the space in the bin. Option 41*c* shown in FIG. 32 provides greater protection of the top of the end panel 41 having less plastic panel exposure to damage, however, it also reduces the capacity of the bin due to the open area above and below the end tube 81 which may not be a problem where the product to be loaded in the bin is large and would not fall through the openings and affect loss of capacity.

What is claimed is:

1. A reinforced double-wall knock-down bin, comprising;

a) a pallet-base having a vertical side-panel at two opposite sides perpendicular to said pallet-base and said pallet-base having a vertical end-panel at two opposite ends perpendicular to said pallet-base, forming an enclosure bin with an open top enabling containment of material placed within, wherein the vertical side-panel and vertical end-panel enable a plurality of bins to be stacked one on top of the other perpendicular to a floor surface;

b) said pallet-base, side-panel and end-panel each having a double-wall formed of a semi-rigid material providing resiliency to withstand impact forces each pallet-base, side-panel and end-panel double-wall having a void between adjacent walls, a foam material, defined as an expandable cellular plastic, inserted into the void to provide reinforcement to said double-walls;

d) each side-panel having a plurality of bottom male extensions and said pallet-base having a plurality of female receptacles on each side of said pallet-base top surface, said bottom male extensions configured to engage within the female receptacles of said pallet-base and each side-panel and each end-panel having a plurality of segmented horizontal end extensions on opposing ends, said end-panel segmented horizontal end extensions engage and inter-mesh with said side-panel segmented horizontal end extensions and said end-panel and side-panel corner extensions having at least one opening on top and one opening on the bottom, said top and bottom openings concentrically match in perpendicularity;

e) said end-panel having means for securing the end of said end-panel at the bottom of said end-panel to the end of said pallet-base, said end-panel having corner end extensions engaging with said end-panel segmented horizontal end extensions on opposing ends, said end-panel corner end extensions having at least one opening on top and one opening on the bottom, said top and bottom openings concentrically match in perpendicularity;

f) said side-panel, and said end-panel having means for holding together a corner point where said side-panel extensions and said end-panel extensions inter-mesh, wherein the openings in the horizontal end extensions of said side-panel and said end-panel corner extensions inter-mesh vertically and concentrically;

g) said side-panel and said end-panel and said pallet-base having means for ventilation and air circulation when required by food handling applications;

h) said pallet-base having means for supporting a load within said bin at said pallet-base center when a bin is stacked on top of another bin;

i) said side-panel and said end-panel having means for reinforcing respective top corners of engagement to provide suitable strength minimizing the tearing out of the top corner of said side-panel;

j) said side-panel having means for internal supporting and reinforcing the side-panel longitudinally at the top, and at both ends for protection against forklift truck abuse;

k) said end-panel having reinforcing means for internal supporting and reinforcing the end-panel at the top and the top corner of said side-panel for protection along the full horizontal length of the top front edge of said end-panel to provide protection against forward impact by front fork tine edges of a forklift truck, and said end panel having fastening means at opposing ends to secure top reinforcing means to said side-panel at the corners; and l) said side-panels and said end-panels each having a plurality of notches at an outer vertical edge of the corners to provide a location to accommodate tie-down rope placement.

2. The reinforced double-wall knock-down bin according to claim 1 further comprising, said side-panel bottom extensions having removable female fastening means and said pallet-base having removable male fastening means which engage with said female fastening means to secure said side-panel to said pallet-base.

3. The reinforced double-wall knock-down bin according to claim 1 further comprising an inter-meshed corner at each interface between said side-panel and said end-panel, said corners are aligned so that the openings, on the horizontal surfaces of said side-panel and said end-panel are vertically concentric, wherein each corner having a corner post fabricated of a material selected from the group consisting of plastic, metal tubing and solid rod inserted vertically, from an underside bottom corner opening of said pallet-base is disposed within the openings of said side-panel and said end-panel extension members so as to secure the interconnected panel members, an underside pallet-base corner outer leg opening having a parallel key-slot access channel enabling insertion of an elongated long nose pliers to grab onto the bottom end of said corner post to extract said corner post to facilitate component replacement.

4. The reinforced double-wall knock-down bin according to claim 1 wherein said pallet-base having a pair of outer legs and a center leg, and opposing ends of said pallet-base having a horizontal tongue between each outer pallet-base leg and the center leg, said end-panel having a first set of horizontal grooves at the bottom forming a tongue-and-groove lock with the tongue.

5. The reinforced double-wall knock-down bin according to claim 4 wherein opposing ends of the outer legs and center leg of said pallet-base having horizontal openings on vertical adjacent walls in concentric alignment, said bin having a plurality of bottom end rods with each bottom end rod inserted into said horizontal openings on the outer legs and center leg with said bottom end rod having end fastening means disposed on each end said rod having a predetermined length to allow concealment of end fastening means within a profile of said pallet-base outer-wall.

6. The reinforced double-wall knock-down bin according to claim 5 further comprising a plurality of vertical gussets in vertical side walls of said pallet-base legs under said openings for insertion of said bottom end rod providing substantial reinforcement to said bottom end rod.

7. The reinforced double-wall knock-down bin according to claim 5 further comprising said end-panel having a second set of horizontal grooves, opposite said first set of grooves of said end-panel, whereby said bottom end rod is also allowed to pass horizontally through said second set of horizontal grooves of said end-panel thereby securing said end-panel to said pallet-base.

8. The reinforced double-wall knock-down bin according to claim 1 further comprising said end-panel having a top corner interconnecting end-panel and side-panel locking means, and said end-panel having a horizontal extension of predetermined length and size extending outwardly from a top end of said end-panel, said side-panel having a corresponding matching recess in a top corner of said side-panel to form a locking arrangement in combination of end-panel and side-panel when assembled.

9. The reinforced double-wall knock-down bin according to claim 1 wherein further comprises a top end bar, said end-panels top each having a hole therein for inserting said top end bar through the hole in the top corner side of one said side-panel then through the top of an adjacent end-panel and then through the opposite top adjacent side corner of said opposite side-panel, said top end bar formed of a material selected from the group consisting of plastic tubing and metal tubing of predetermined length to allow concealment of said top end bar within the profile of said side panels which is centered within the length of said end-panel extending into said opposite side panels ends, said top end bar having fastening means, comprised of a flat washer and a lock-nut, applied to each end of said top end bar, wherein said fastening means substantially secures top end corner of said side-panel thereby preventing the top side corner of said side-panel from flexing outwardly under load force exerted from within said bin.

10. The reinforced double-wall knock-down bin according to claim 9 further comprising said end-panel horizontal top end having a contour to closely fit over said top end bar on opposite sides.

11. The reinforced double-wall knock-down bin according to claim 9 further comprising said end-panel horizontal top end having a straight surface to provide a uniform top surface when required by a specific application.

12. The reinforced double-wall knock-down bin according to claim 9 wherein said end-panel horizontal top end having a cut out on opposite sides of said end-panel top area in a center portion thereof forming a stacking land for said pallet-base center leg underside end for stacking a bin on top of another bin, thereby exposing said top end bar horizontally on opposite sides of said end-panel top center to reduce possible damage to forklift access bin top area of said end-panel.

13. The reinforced double-wall knock-down bin according to claim 1 wherein said pallet-base having a plurality of molded-in reinforcing recesses on an underside of said pallet-base, said recesses perpendicular to said pallet-base bottom walls and joined at the top of the underside of the pallet-base top wall thereby providing substantial reinforcing strength to the pallet-base bottom surface to aid in the support of the load within.

14. The reinforced double-wall knock-down bin according to claim 4 further comprising, said pallet-base having two horizontal channels on an underside surface between the outer leg and center leg of said pallet-base spaced and centered to provide distributed load support of the load within the bin, said pallet-base having a plurality of openings in walls of the underside of said pallet-base legs wherein said bin having a pallet support bar made of a metal tube having a predetermined length, inserted into said openings in the vertical walls and channels, said side panel having support bar retaining means on a bottom outside edge, said retaining means comprising a plurality of predetermined extensions at a bottom outer edge of said side-panel of suitable size to engage in corresponding recesses in said pallet-base top to close off the insertion opening of said pallet-base support bar when said side-panel is assembled to said pallet-base.

15. The reinforced double-wall knock-down bin according to claim 1 wherein said pallet-base top having a plurality of receptacles forming an upper tapered conical structure and the bottom having a corresponding connecting and concentrically inverted tapered conical structure and said side-panel bottom having a tapered extension wherein said tapered extension is integrally connected to a corresponding downward oppositely tapered conical structure, said combination of tapered conical structures provide substantial reinforcing strength to additionally and uniformly distribute the load within the bins over the plurality of said tapered concentric conical structures directed downwardly toward the plurality of bins stacked below and, finally, to the bin on the bottom of the stack and to the floor stacking surface.

16. The reinforced double-wall knock-down bin according to claim 7 said pallet-base further comprising said pallet-base having a plurality of vertical gussets in vertical side-walls of said pallet-base legs under said openings provided for insertion of said pallet-base support bar providing substantial reinforcement to said bottom support bar.

17. The reinforced double-wall knock-down bin according to claim 1 wherein said side-panel having a molded-in metal side rod of predetermined length, concealed at the top of said side-panel, and said side rod having an offset closed-loop on each end, wherein said end-panel having a horizontal top end bar extension that fits into the offset closed-loop ends of the horizontal top end bar extension thereby providing a complete substantial reinforcement structure around the top perimeter of said bin.

18. The reinforced double-wall knock-down bin according to claim 1 wherein said pallet-base and said side-panel and said end-panel having a plurality of ventilation slots molded-in, at a predetermined location and size provide adequate ventilation, and substantial wall strength to the structure.

19. The reinforced double-wall knock-down bin according to claim 1 wherein said side-panel and said end-panel segmented horizontal end extensions having a notch of predetermined size, wherein said corner notch provides a location for the placement of a tie-down rope commonly used by contract camers to secure a plurality of bins to an over-the-road open flatbed trailer truck by first securing the tie-down rope to the forward rack on the trailer then bringing the tie-down rope horizontally to the rear of the trailer and engaging the rope in said corner bin notch on the last bin at the rear of the group to hold the tie-down rope in place and then, finally, bringing the tie-down rope down on an angle to the opposite back end of trailer and securing the tie-down rope to the trailer bed corner, repeating the process on the opposite side of the trailer.

* * * * *